US007325909B2

(12) United States Patent
Yuen

(10) Patent No.: US 7,325,909 B2
(45) **Date of Patent: *Feb. 5, 2008**

(54) AUTOMATIC INK REFILL SYSTEM AND METHODS

(76) Inventor: Kenneth Yuen, P.O. Box 208, San Gabriel, CA (US) 91776

( * ) Notice: Subject to any disclaimer, the term of this patent is extended or adjusted under 35 U.S.C. 154(b) by 377 days.

This patent is subject to a terminal disclaimer.

(21) Appl. No.: 11/117,963

(22) Filed: Apr. 28, 2005

(65) Prior Publication Data

US 2006/0244794 A1 Nov. 2, 2006

(51) Int. Cl.
*B41J 2/175* (2006.01)

(52) U.S. Cl. ..... 347/85

(58) Field of Classification Search ..... 347/85, 347/86, 87; 141/2, 18
See application file for complete search history.

(56) References Cited

U.S. PATENT DOCUMENTS

| | | | | |
|---|---|---|---|---|
| 2,057,614 | A | 10/1936 | Girard | |
| 2,554,948 | A | 5/1951 | Kiefer | |
| 2,876,665 | A | 3/1959 | Lecours | |
| 3,404,593 | A | 10/1968 | Arcarose et al. | |
| 3,828,976 | A | 8/1974 | Sidelinker | |
| 4,074,284 | A | 2/1978 | Dexter et al. | |
| 4,183,031 | A | 1/1980 | Kyser et al. | |
| 4,506,276 | A | 3/1985 | Kyser et al. | |
| 4,507,056 | A | 3/1985 | Allen | |
| 4,708,033 | A | 11/1987 | Eash | |
| 4,842,028 | A | 6/1989 | Kaufman et al. | |
| 5,129,566 | A | 7/1992 | Ogden et al. | |
| 5,199,470 | A | 4/1993 | Goldman | |
| 5,270,219 | A | 12/1993 | DeCastro et al. | |
| 5,315,317 | A | 5/1994 | Terasawa et al. | |
| 5,329,294 | A * | 7/1994 | Ontawar et al. | 347/87 |
| 5,400,573 | A | 3/1995 | Crystal et al. | |
| 5,409,134 | A | 4/1995 | Cowger | |
| 5,488,400 | A | 1/1996 | Crystal et al. | |
| 5,495,877 | A | 3/1996 | Schwenk et al. | |
| 5,526,030 | A | 6/1996 | Baldwin et al. | |
| 5,531,055 | A * | 7/1996 | Sell et al. | 53/86 |
| 5,537,134 | A | 7/1996 | Baldwin et al. | |

(Continued)

FOREIGN PATENT DOCUMENTS

EP 0 640 484 A2 3/1995

(Continued)

OTHER PUBLICATIONS

"Instructions for refilling a HP 26A/29A ink cartridge" and "Troubleshooting Guide," *Dataproducts*, 2 pgs, date unknown.

(Continued)

*Primary Examiner*—Anh T. N. Vo
(74) *Attorney, Agent, or Firm*—Merchant & Gould P.C.

(57) ABSTRACT

An ink refill device and method for refilling an ink reservoir (s) of a printer ink cartridge. The ink refill device includes an ink container that defines an internal ink tank(s) containing ink, drain and vent members that are adapted and arranged to replenish the ink reservoir(s) with ink from the ink tank(s). The drain and vent member are arranged to provide an elongate conduit profile. The drain and vent member may be arranged coaxially, bisectionally, or in some other orientation relative to each other to provide the single elongate conduit profile.

22 Claims, 10 Drawing Sheets

U.S. PATENT DOCUMENTS

| | | | | | |
|---|---|---|---|---|---|
| 5,546,996 | A | | 8/1996 | Broyles et al. | |
| 5,551,643 | A | | 9/1996 | Chapin | |
| 5,572,852 | A | | 11/1996 | Crystal et al. | |
| 5,581,287 | A | | 12/1996 | Baezner et al. | |
| 5,607,003 | A | | 3/1997 | Gray | |
| 5,686,948 | A | | 11/1997 | Crystal et al. | |
| 5,790,157 | A | * | 8/1998 | Higuma et al. | 347/85 |
| 5,819,627 | A | | 10/1998 | Hayao | |
| 5,838,352 | A | * | 11/1998 | Martinez | 347/87 |
| 5,845,682 | A | | 12/1998 | Hayao | |
| 5,886,719 | A | | 3/1999 | Zepeda | |
| 5,912,687 | A | | 6/1999 | Cowger et al. | |
| 5,917,523 | A | | 6/1999 | Baldwin et al. | |
| 5,917,526 | A | | 6/1999 | Wilson et al. | |
| 5,933,175 | A | | 8/1999 | Stathem et al. | |
| 5,967,196 | A | * | 10/1999 | Moser | 141/18 |
| 6,022,102 | A | * | 2/2000 | Ikkatai et al. | 347/85 |
| 6,053,603 | A | | 4/2000 | Ito | |
| 6,099,115 | A | | 8/2000 | Faoro | |
| 6,139,137 | A | | 10/2000 | Stanthem et al. | |
| 6,158,848 | A | | 12/2000 | Liu | |
| 6,158,851 | A | | 12/2000 | Zepeda | |
| 6,172,695 | B1 | | 1/2001 | Liu | |
| 6,273,151 | B1 | | 8/2001 | Kong | |
| 6,347,863 | B1 | * | 2/2002 | Yuen | 347/85 |
| 6,969,161 | B2 | * | 11/2005 | Kuwabara et al. | 347/85 |
| 6,971,740 | B2 | * | 12/2005 | Yuen | 347/85 |
| 7,104,639 | B2 | * | 9/2006 | Hermes et al. | 347/85 |
| 7,192,126 | B2 | * | 3/2007 | Hilton et al. | 347/85 |
| 2004/0055661 | A1 | | 3/2004 | Yuen | |

FOREIGN PATENT DOCUMENTS

| | | | |
|---|---|---|---|
| EP | 0 864 428 | A2 | 9/1998 |
| EP | 1 403 067 | A1 | 3/2004 |
| JP | 09094799 | | 4/1997 |
| WO | WO 02/26502 | A1 | 4/2002 |
| WO | WO 2004/026581 | | 4/2004 |

OTHER PUBLICATIONS

"Refilling Instructions for Hewlett-Packard 51625A Print Cartridges (Kit #DJRE500C) [and] for Hewlett-Packard 51649A Print Cartridges (Kit #DJRE600C)," *Repeat-O-Type Manufacturing Corporation*, Wayne, NJ, 1 pg. (Jan. 1998).

"Canon BX-03 Printer Cartridge Refilling Instructions," http://www.pclincs.co.uk/Printer/canon_bx-03.html, 2 pages (Printed Mar. 21, 2003).

"Instructions for Refilling Lexmark & Dell Color Cartridges," 1 page (2003).

"Instructions for use on cartridges Canon BCI-3eC, eM, eY, eBk," http://www.fifty.cz/English/N%/C3%A1vody/aRBJ3000.htm, 1 page (Printed Mar. 21, 2003).

"Save on Ink. Frequently Asked Questions," http://trinishops.com/saveonink/faq.htm, 6 pages (Printed Mar. 21, 2003).

* cited by examiner

FIG. 1
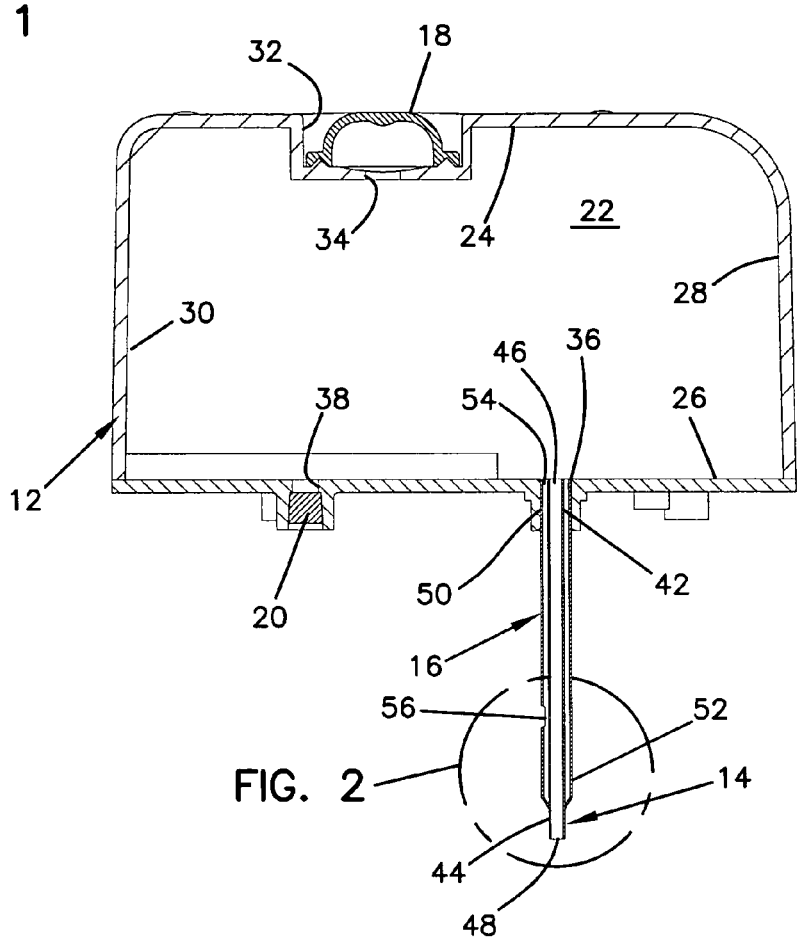
FIG. 2
FIG. 2A
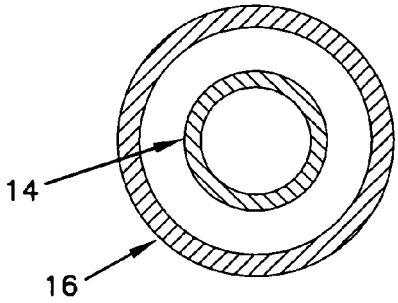
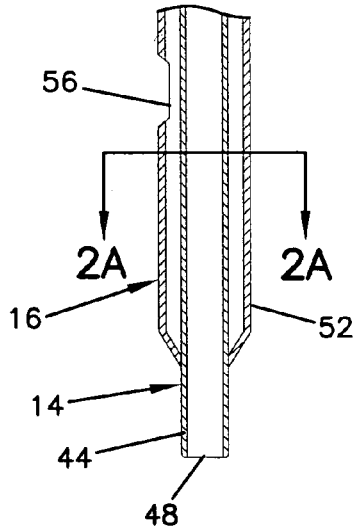

AUTOMATIC INK REFILL SYSTEM AND METHODS

TECHNICAL FIELD

The present invention generally relates to filling containers with fluid, and more specifically relates to refilling printer ink cartridges.

BACKGROUND

Ink jet printers are a popular form of printer used with computers and similar applications involving document printing or graphics preparation. Typical ink jet printers have replaceable ink jet cartridges with built-in print heads. While replaceable ink jet cartridges are a convenient manner of supplying ink to such printers, the cartridges are necessarily expensive due to their complexity and the provision of print heads with the cartridges. Cartridges provided by manufacturers are typically not designed to be refilled when the ink supply runs out. It is well known, however, that such cartridges have useful lives significantly longer than that provided by the initial supply of ink. As a result, there have been substantial efforts directed at providing a simple, easy-to-use system for refilling cartridges with ink.

Known ink cartridge refill systems may have certain drawbacks related to ink flow from the ink refill system to the printer cartridge. Therefore, additional efforts have been directed at providing reliable, consistently functioning systems for refilling printer cartridges with ink.

SUMMARY

An ink refill device and method for refilling an ink reservoir(s) of a printer ink cartridge. The ink refill device includes an ink container that defines an internal ink tank(s) containing ink, drain and vent members that are adapted and arranged to replenish the ink reservoir(s) with ink from the ink tank(s). The drain and vent member are arranged within a single elongate conduit profile. The drain and vent member may be arranged coaxially, bisectionally, or in some other orientation relative to each other that provides the single conduit profile.

Another aspect of the disclosure relates to an ink cartridge refilling system that is configured to refill a housing interior of a printer ink cartridge. The system includes an ink container having at least one ink reservoir and configured to be connected to the printer ink cartridge housing, and at least one ink communication path in fluid communication with the at least one ink reservoir. The system also includes at least one vent communication path in fluid communication with the at least one ink reservoir, wherein a combination of the at least one ink communication path and the at least one vent communication path is defined within a single elongate conduit profile.

One method according to principles of the present disclosure relates to assembling of an ink refill system. The method includes providing an ink container, a drain conduit, and a vent member, the drain conduit and vent member together defining an elongate member having a generally cylindrical cross-section. The method also includes coupling the elongate member to the ink container, wherein a first end of each of the drain conduit and the vent member is exposed within the ink container and a second end of each of the drain conduit and vent member is exposed outside of the ink container.

A still further aspect of the disclosure relates to an ink cartridge refill kit. The refill kit includes a package and an ink refill system positioned in the package. The ink refill system includes an ink tank, a drain conduit, and a vent conduit. The drain conduit is in ink flow communication with the internal ink tank, the vent conduit is in air flow communication with the internal ink tank, and the drain conduit and air conduit extending coaxially from a position exposed to ink in the ink tank to a position exterior of the ink tank.

Another aspect of the disclosure relates to a method of refilling an ink cartridge with an ink refill system. The ink refill system includes a drain conduit, a vent member, and an ink container filled with ink. The method may includes steps of forming an aperture in a wall of the ink container, defining the drain conduit and vent member within a single elongate conduit profile, inserting the drain conduit and vent member into the aperture, and draining ink out of the ink container through the drain conduit and filling the ink container with air through the vent member to fill the ink cartridge.

A still further aspect of the disclosure relates to an ink cartridge refill system configured to refill an ink chamber of a printer ink cartridge with ink. The system includes an ink container, a drain conduit, a vent member, and a sealing member. The ink container is configured for coupling in ink flow communication with the ink cartridge, wherein the ink container defines at least one internal ink tank and the ink tank includes a bottom wall having a conduit aperture form therein. The drain conduit is in fluid communication with the at least one internal ink tank through the conduit aperture and projecting outwardly from the ink container. The vent member extends coaxially with the drain conduit and in fluid communication with the at least one internal ink tank. The sealing member is positioned between the ink container and at least one of the drain and vent conduits to provide a fluid seal there between. In a coaxial arrangement wherein the drain conduit extends within the vent conduit, the sealing members seals between an outer surface of the vent member and the ink container such as at the bottom wall of the ink container adjacent to the conduit aperture.

The above summary is not intended to describe each disclosed embodiment or every implementation of the inventive aspects disclosed herein. Figures in the detailed description that follow more particularly describe features that are examples of how certain inventive aspects may be practiced. While certain embodiments are illustrated and described, it will be appreciated that the invention/inventions of the disclosure are not limited to such embodiments.

BRIEF DESCRIPTION OF THE DRAWINGS

FIG. 1 is a cross-sectional side view of an example ink refill device;

FIG. 2 is a close-up view of the coaxially arranged drain and vent conduits of the refill device shown in FIG. 1;

FIG. 2A is a cross-sectional view of the coaxially arranged drain and vent conduits shown in FIGS. 1 and 2 taken along cross-section indicators 2A-2A;

Figure 3:
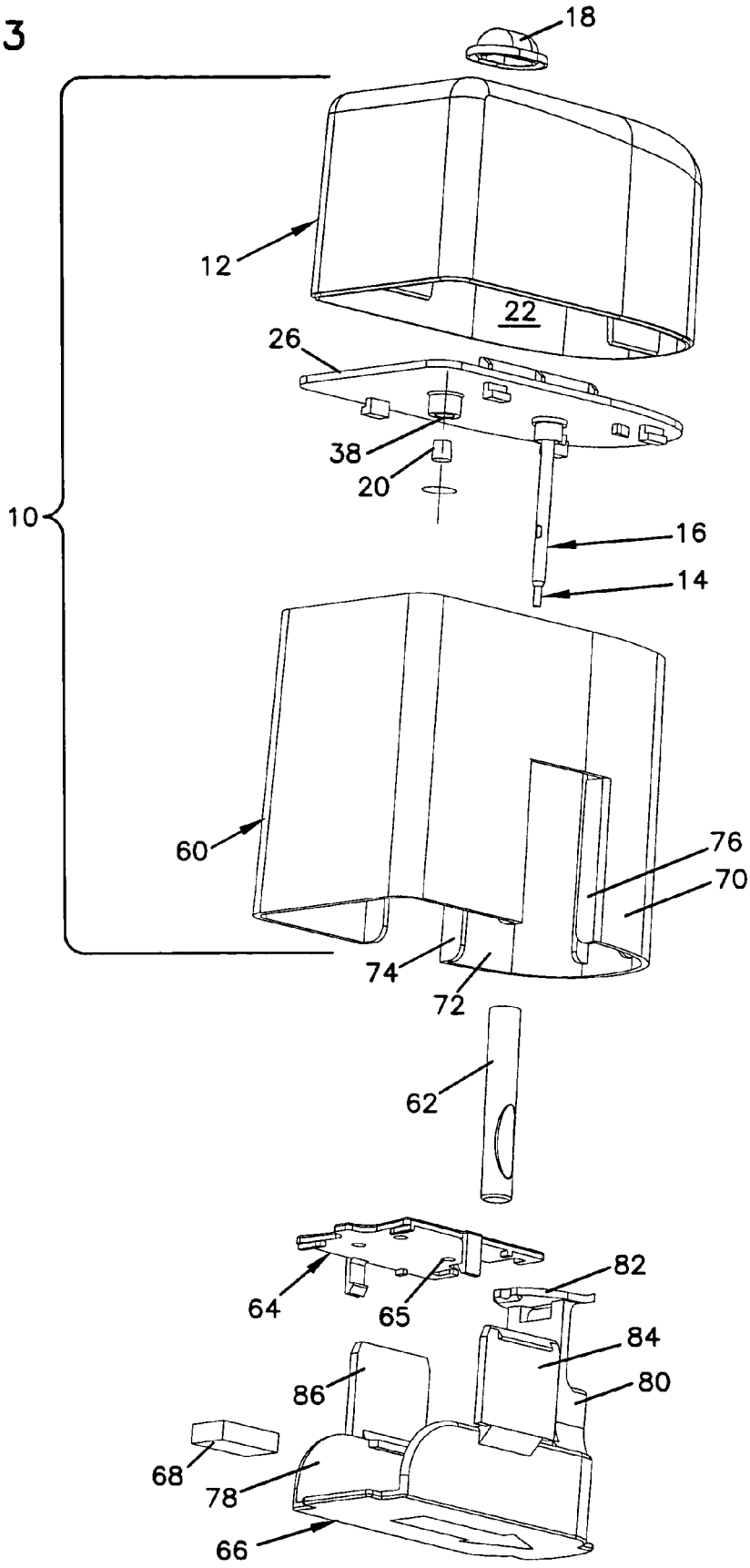
FIG. 3 is an exploded perspective view of an ink refill system that includes the ink refill device shown in FIG. 1.

While the inventive aspects of the present disclosure are amenable to various modifications and alternate forms, specific embodiments thereof have been shown by way of example in the drawings, and will be described in detail. It should be understood, however, that the intention is not to limit the inventive aspects to the particular embodiments described. On the contrary, the intention is to cover all modifications, equivalents, and alternatives falling within the spirit and scope of the inventive aspects.

DETAILED DESCRIPTION OF THE PREFERRED EMBODIMENT

The present disclosure provides an ink refill system for filling a refillable container such as a printer ink cartridge. The refill system includes an ink refill apparatus that includes an ink tank containing refill ink, at least one ink conduit configured to provide ink flow communication with the container to be filled, and a venting structure configured to provide venting in the container to be filled during ink flow communication. When in use, the refill apparatus facilitates ink flow from the ink tank of the ink refill apparatus to the container to be filled with ink. The following detailed description, with reference to FIGS. 1-11, describes an ink refill system, an ink refill kit that includes an ink refill apparatus, methods of assembling an ink refill system, and methods of using the ink refill kit to fill an ink cartridge.

As used herein, the terms "printer ink cartridge", "ink cartridge", "printer cartridge", and "cartridge" generally refer to an ink cartridge for an ink jet printer. A printer ink cartridge may be configured to include an inlet port that facilitates fluid communication with an interior chamber of the cartridge. The present disclosure utilizes such an inlet port of an ink cartridge to refill the cartridge using an easy-to-use method and apparatus, examples of which are described herein. The term "coaxial" is defined as having two coincident axes. The term "bisectional" is defined as a single member having a dividing feature that provides two sections or spaces. A "bisectional conduit" includes a dividing partition or wall within an interior and along a length of the conduit to provide two passages within the conduit.

FIGS. 1, 2 and 2A illustrate portions of an ink refill apparatus that exemplify how inventive concepts disclosed herein can be practiced. The illustrated portions of the ink refill apparatus include an upper housing member 12, a drain conduit 14, a vent conduit 16, a pump member 18, and a refill plug 20. The drain and vent conduits together define a drain/vent assembly 15 having an elongate conduit profile. The drain and vent conduits 14, 16 are coaxially aligned with the drain conduit positioned at least partially within an interior volume defined by the vent conduit 16.

The upper housing member 12 includes an internal ink tank or container 22 defined by bottom, top and first and second side interior walls 24, 26, 28, 30. A recess 32 is formed in the bottom interior wall 24 and sized to retain the pump member 18. An interior space defined by the pump member 18 is in fluid communication with the internal ink tank 22 via pump opening 34. A refill opening 38 is formed in the top interior wall 26 to provide refilling of ink into the internal ink 22. The refill opening 38 is capped or filled with the refill plug 20. A vent/drain opening 36 is also formed in the top interior wall 26. The drain/vent assembly 15 is positioned in fluid communication with the internal ink tank 22 via the vent/drain opening 36.

The drain conduit 14 includes first and second ends 42, 44 and first and second openings 46, 48 at the respective ends 42, 44. The vent conduit 16 includes first and second ends 50, 52 with first and second openings 54, 56. The second end 52 of the vent conduit 16 may be crimped or otherwise sealed shut against an exterior of the drain conduit 14 at the second end 44, or may be left open relative to the drain conduit. The second opening 56 may be positioned at any location along the length of the vent conduit 16 proximal of the opening 48 at the second end 44 of the drain conduit. The position of the second opening 56 determines the fill level in the cartridge. The position of the second opening 56 is predetermined according to the fill level desired and may be formed at different positions for different applications.

In other embodiments, the second end 52 is left open to provide different venting options. An open end of the vent conduit 52 may be used in place of or in combination with an opening formed in a side wall of the vent conduit (e.g., opening 56). In still further embodiments, the drain and vent conduits 14, 16 may have the same length. Typically, providing a vent conduit having a lower opening (e.g., opening 56 or an opening at the second end 52) that is at the same or a vertically higher level than the second opening 48 of the drain conduit 14 (when refilling the cartridge) results in optimum draining of ink and venting of air. However, in some configurations it may be possible to have a second opening of the vent conduit that is lower than a second opening of the drain conduit or have a second end of the vent conduit that extends distally beyond the second end of the drain conduit.

Figure 7:
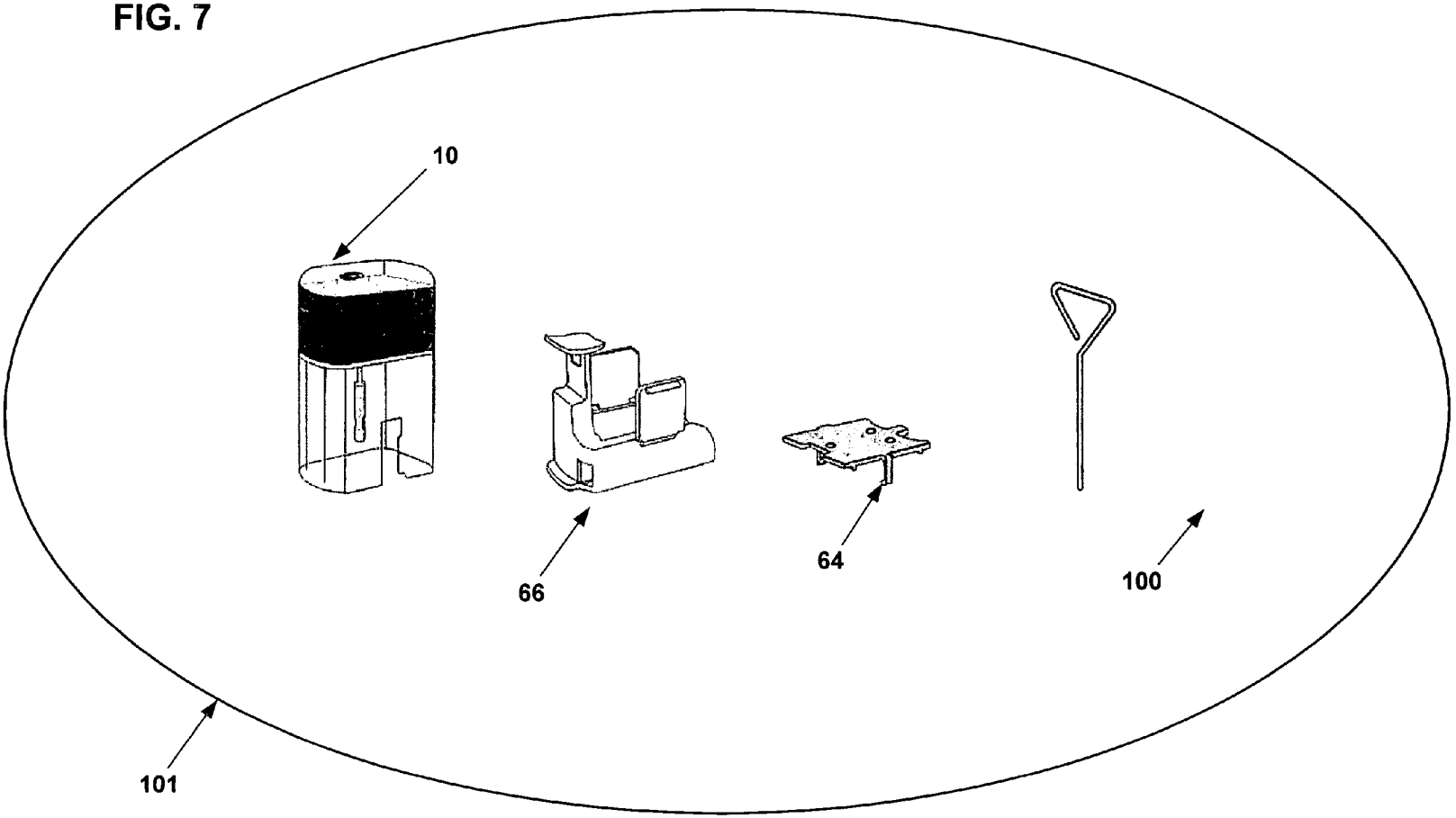
FIG. 7 is a perspective view showing several features of an ink refill kit.

The portions of the ink refill apparatus shown in FIGS. 1 and 2 can be part of the ink refill apparatus 10 shown in FIG. 3 and used in combination with other components of an ink refill kit 101 shown in FIG. 7. The ink refill apparatus 10 includes a lower housing member 60 that is coupled to the housing member 12. The lower housing member 60 includes a side wall 70, an opening 72, and track portions 74, 76 formed in the side wall 70 and open at the open end 72. When the upper and lower housings 12, 16 are combined (see, for example, apparatus 10 shown in FIG. 7), the lower housing member 60 provides an enclosure within which an ink cartridge is positioned while being refilled with ink from the internal ink tank 22.

FIG. 3 also illustrates a conduit cap 62, a drill and/or tube guide 64, a base member 66, and an ink absorbing member 68. The conduit cap 62 is sized and configured to fit over the exposed end of the drain/vent assembly 15 to prohibit ink flow throughout of the drain/vent assembly 15. The drill guide 64 is configured for attachment to an end of an ink cartridge that is to be refilled. The drill guide 64 includes an opening 65 that is positioned in alignment with an ink refill opening of the ink cartridge (see FIGS. 8A-E described below).

The base member 66 includes a cartridge seat 78, a guide support 80, a retaining clip 82, and latch arms 84, 86. A cartridge (not shown) is retained by the base member 66 with one end of the cartridge fit in the cartridge seat 78, and an opposing end of the cartridge retained by the retaining clip 82. The retaining clip 82 may be lifted up manually or when engaged by the cartridge being fit in the cartridge seat 78 and then latched to a top surface of the cartridge to retain the cartridge in the base member 66. The latch arms 84, 86 fit within the track portions 74, 76 of the lower housing member 60 to help properly align the opening 65 in the drill guide 64 with the drain/vent assembly 15 when inserting the cartridge into position for refilling in the ink refill apparatus 10 (see FIGS. 9B-C).

The ink absorbing member 68 is positioned along a bottom surface of the cartridge seat 78 in alignment with the cartridge printer head and is configured to absorb any ink that may be expelled from the printer head while refilling the cartridge. The ink absorbing member 68 may include a non-porous foam or sponge material. The ink absorbing member 68 may function to prevent ink leakage from the print head of the cartridge and provide cushioning for the print head.

Figure 4:
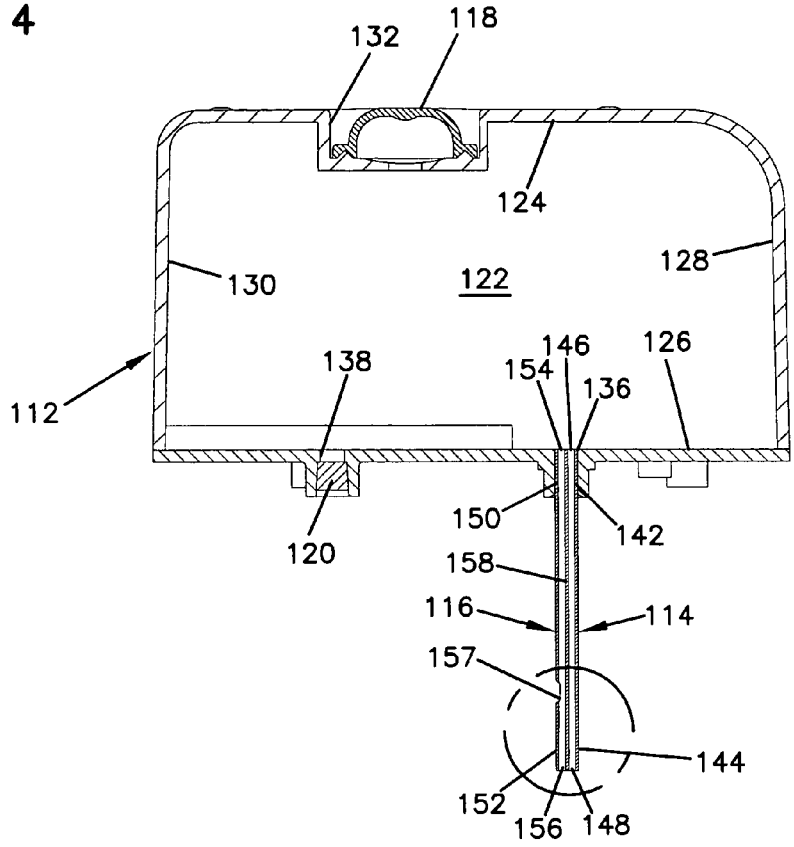
FIG. 4 is a cross-sectional side view of another example ink refill device.
Figure 5:
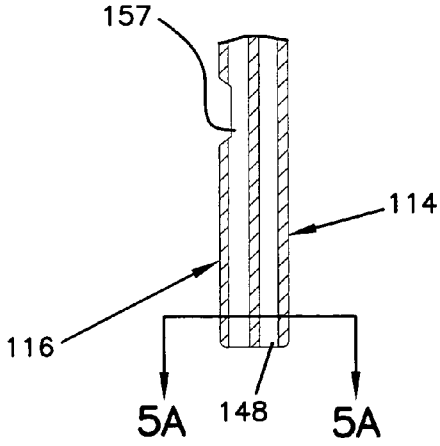
FIG. 5 is a close-up view of the bisectionally arranged drain and vent conduits of the refill device shown in FIG. 4.
Figure 5A:
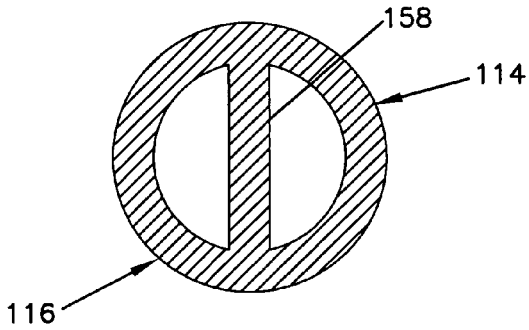
FIG. 5A is a cross-sectional view of the bisectionally arranged drain and vent conduits shown in FIGS. 4 and 5 taken along cross-section indicators 5A-5A.

Referring now to FIGS. 4, 5 and 5A, a portion of another ink refill apparatus is shown and described. This embodiment includes an upper housing member 112, 114, a vent conduit 116, a pump member 118, and a refill plug 120. The vent and drain conduits together define a drain/vent assembly 115 having a bisectional configuration. While an exterior of the drain/vent assembly is that of a single elongate member profile, an interior of the drain/vent assembly 115 includes a partition member 158 that defines the separate drain and vent conduits 114, 116.

The upper housing member 112 includes an internal ink tank 122 defined by bottom, top and first and second side interior walls 124, 126, 128, 130. A recess 132 is defined in the bottom interior wall 124 and sized to retain the pump member 118. The vent/drain opening 136 is defined in the top interior wall 126 and sized to receive the drain/vent assembly 115 to provide fluid communication between the ink tank 122 and the drain and vent conduits 114, 116. A refill opening 138 is also defined in the top interior wall 126. The refill plug 120 can be inserted into the refill opening 138 to prevent ink from draining out of the internal ink tank 122.

The drain conduit 114 includes first and second ends 142, 144 and first and second openings 146, 148 at respective ends 142, 144. The vent conduit includes first and second ends 150, 152 and first and second openings 154, 156 at respective ends 150, 152. A third opening 157 may be defined in a side wall of the vent conduit 116 along the length thereof between the first and second ends 150, 152.

The partition 158 may have various configurations and positioned orientations that affect the size and shape of the drain and vent conduits 114, 116. In some instances, it may be advantageous to provide a drain conduit that is larger in cross sectional area then the vent conduit to optimize ink flow out of the ink tank 122. Due to viscosity and other physical characteristics of the ink as compared to air, a larger cross sectional area for the drain conduit is typically preferred so as to provide ink flow out of the ink chamber through the drain conduit at substantially the same rate as the air flow into the ink chamber through the vent conduit.

Figure 6:
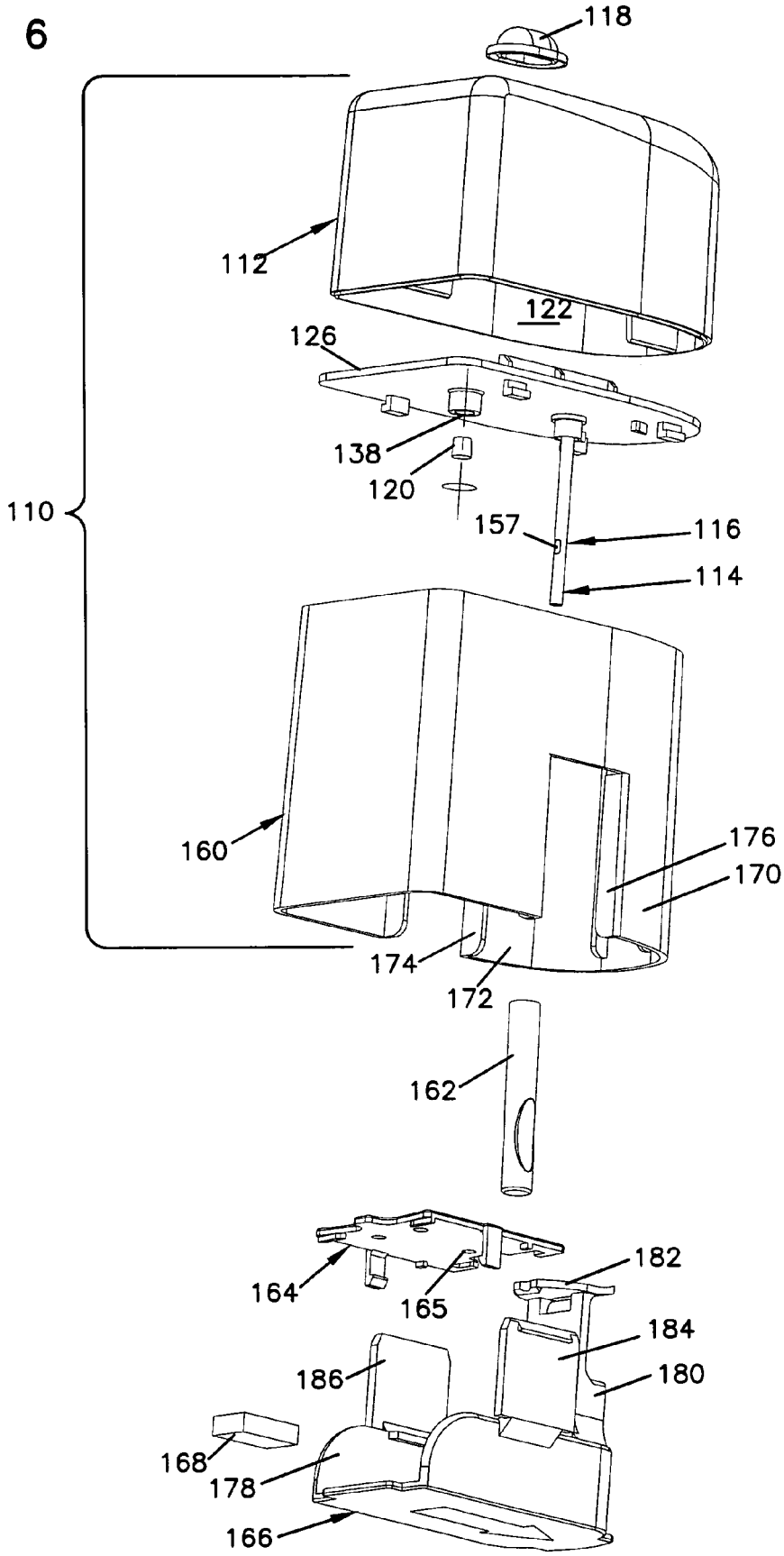
FIG. 6 is an exploded perspective view of an ink refill system that includes the ink refill device shown in FIG. 4.

Those features illustrated in FIGS. 4 and 5 may be part of an ink refill apparatus 110 illustrated in FIG. 6 that is used in combination with other features of an ink refill kit 101 shown in FIG. 7. The ink refill apparatus 110 may also include a lower housing member 160 configured for engagement and/or attachment with the upper housing 112. The lower housing member 160 includes a side wall 170, an open end 172, and track portions 174, 176 formed in the side wall 170 and open to the opening 172. The lower housing member 160 provides an enclosure within which an ink cartridge may be positioned while refilling with ink from the internal ink tank 122 via the drain/vent assembly 115 (see, for example, FIG. 9C).

The ink refill kit may also include a vent cap 162, a drill guide 164, a base member 166, and a sponge or other ink absorbent member 168. The conduit cap 162 is sized to fit over the drain/vent assembly 115 to prevent the flow of ink out of the internal ink tank 122 when the drain/vent assembly 115 is not being used for filling an ink cartridge. The drill guide 164 is configured for attachment to an ink cartridge that includes an opening 165 that is aligned with an ink refill opening of the ink cartridge (see, for example, FIGS. 8A-C). The drill guide 164 is configured to help direct a drill member (see, for example, drill 100 shown in FIG. 7) or the drain/vent assembly 115 into the ink cartridge.

The base member 166 includes a cartridge seat 178, a guide support 180, a guide 182, and latch arms 184, 186. The cartridge seat 178 is configured to retain one end of an ink cartridge and the guide 182 is configured to engage and retain an opposing end of the ink cartridge. The latch arms 184, 186 fit within the track portions 174, 176 of the lower housing member to help align and direct the drain/vent assembly 115 through the opening 165 and the drill guide 164 (see, for example, FIGS. 9B-C). The sponge 168 is positioned along the cartridge seat 178 for alignment with a printer head of the ink cartridge. The sponge 168 is configured to absorb any ink that may be expelled from the print head while refilling the ink cartridge.

The drill guides 64, 164 described above may have multiple embodiments in accordance, for example, with those drill guides disclosed in U.S. Ser. No. 10/438,254 filed on May 13, 2003 and entitled DRILL GUIDE FOR AN INK REFILL SYSTEM, which application is incorporated herein by reference. The pump members 18, 118 described above may have various configurations and related advantages discussed, for example, in U.S. Ser. No. 10/817,424 filed on Apr. 2, 2004, and entitled ACTUATOR FOR AUTOMATIC INK REFILL SYSTEM, which application is incorporated herein by reference.

While the embodiments shown and described with reference to FIGS. 1-6 illustrate a single drain/vent assembly associated with each of the ink refill apparatuses 10, 110, other embodiments may include multiple internal ink tanks and a separate drain/vent assembly associated with each of the internal ink tanks. An example configuration having three internal ink tanks is shown and described in U.S. Ser. No. 10/817,424. A separate pump member may be associated with each of the internal ink tanks to provide additional pressure that helps initiate ink flow from the ink tank, through the drain conduit, and into the ink cartridge.

A drain/vent assembly having a single elongate conduit profile such as shown and described with reference to FIGS. 1-6 may provide certain advantages over known vent assembly systems. An example drain/vent assembly system that includes spaced apart drain and vent conduits is shown and described with reference to U.S. Pat. No. 6,347,863, which patent is incorporated herein by reference.

In operation, a coaxial, bisectional, or other drain/vent assembly configuration with a single elongate conduit profile uses similar principles as discussed in U.S. Pat. No. 6,347,863. Such general principles relate to a closed system in which the flow of a liquid out of the system must be balanced by an equal volume of fluid into the system. The ink refill apparatuses 10, 110 include three basic elements: an enclosed ink tank filled with ink, a drain conduit and a vent conduit. The lower ends of the conduits are inserted into a printer cartridge. When the ink level in the cartridge is low, the ink flows out of the drain conduit and seeps into the internal ink cavity of the ink cartridge (which is typically filled with a foam material) causing a vacuum in the internal ink tank of the ink refill apparatus. This vacuum condition draws air up from the internal ink cavity of the ink cartridge, through the vent conduit, and into the internal ink tank. When the level of the ink cartridge rises to the highest opening of the vent conduit, the ink seals the ink conduit to prevent air flow into the internal ink tank. Without such an air flow, it is not possible for ink to flow out of the internal ink tank into the ink cartridge.

Prior to ink flow from the ink tank of the refill apparatus into the cartridge through the drain conduit at the outset of the refill process, both the vent tube and drain tube have an air/ink mixture in them. After some time period, capillary forces generated by fluid in the ink and drain conduits causes ink in the ink tank to begin flowing through the longer of the drain and vent conduits. Simultaneously, air begins flowing through the shorter of the drain and vent conduits under vacuum forces caused by ink leaving the ink tank. Since it is advantageous to fill the ink cartridge with ink from the bottom towards the top in order to prevent the trapping of air beneath the ink, having ink flow through the longer of the drain and vent conduits is advantageous for the filling process.

An advantage of a two-tube drain/vent assembly is that it is clean and "automatic" in that it operates upon principles of gravity. Although a pump member has been included in the embodiments shown and described herein for use in initiating ink flow out of the internal ink tank, there is otherwise no need to force the ink into the ink cartridge. Furthermore, the larger the cross-section of the drain conduit, the less need there is to initiate ink flow in the drain conduit. By eliminating the need to force ink into the cartridge, the possibility of spilling is significantly reduced. Further, the flow of ink into the ink cartridge is typically relatively slow due to the size of the drain and vent conduits. In most circumstances, this relatively slow flow of ink is preferred so as to allow complete absorption of the ink into the foam of the ink cartridge. However, when using the example ink refill apparatuses with an ink cartridge that does not include foam, it may be possible to provide drain and vent conduits with larger sizes or other configurations that provide increased ink flow so as to speed up the process of filling the ink cartridge. If a cartridge does not include foam to retain the ink, other means of ink retention (e.g., negative pressure or one-way valves) must be used. The two-tube system of the present disclosure may work less effectively with cartridges that include a vacuum condition.

Another advantage of the example systems disclosed herein is that the refill level in the ink cartridge is controlled by the position of the opening into vent conduit. Positioning the opening into the vent conduit (the opening positioned within the ink cartridge) at a certain height will control the level of ink filling within the ink cartridge. The drain/vent assemblies 15, 115 described above include second openings 56, 156 that are formed in a side of a conduit 116, which second opening may be repositioned at any location along the length of the vent conduit to control the ink level in the ink cartridge.

Using a drain/vent assembly with a single elongate conduit profile also provides several advantages over a system that includes separated, spaced apart vent and drain conduits. One advantage of using a single elongate conduit is that the conduit cap requires a single opening that functions to cap both the drain and vent conduit. This is an important advantage over a cap that requires a separate opening for each conduit. In a two opening cap configuration, it can be difficult to simultaneously fit the cap over both conduits (which is typically required). It may also be difficult to provide a proper seal on both the drain and vent conduits with a two opening cap because the cap is relatively small and very tight tolerances are required for the openings to provide the proper seal. By eliminating one of these openings, the overall cap size and the opening in the cap can be increased, which can improve the required tolerances necessary to perform the proper seal, reduce manufacturing costs, and improve the easy of fitting the cap onto the conduits.

A further advantage of a drain/vent assembly with a single elongate conduit profile is that only one vent/drain opening must be formed in the upper housing member in order to provide fluid communication into the internal ink tank. Providing one hole versus two holes reduces manufacturing and assembly costs by simplifying the overall design of the ink refill apparatus.

A further advantage of a drain/vent assembly with a single elongate conduit profile is that the drain conduit cross-sectional area can be modified relative to the vent conduit cross-sectional area to optimize the ink flow for a given ink cartridge application. In either the coaxial or bisectional configuration, the drain/vent assembly can be modified for customization that provides the desired ink flow. A related advantage is that the overall cross-sectional area available for fluid flow in a coaxial or bisectional tube is typically greater than a pair of side-by-side tubes. As a result, more flow may be possible in the coaxial and bisectional configurations as compared to a side-by-side tube arrangement. The cross-sectional area of the conduits may be limited by, for example, the size of the opening into the conduit. The opening into the conduit may be determined according to other considerations more relevant to, for example, performance of the ink cartridge.

Another advantage relates to controlling the cross-sectional area of the vent conduit. The cross-sectional area of the vent conduit is typically required to be less than the cross-sectional area of the drain conduit for reasons related to viscosity and other flow properties of the two fluids (e.g., ink and air). In a coaxial conduit configuration, a relative small difference between the inner diameter of the outer conduit and an outer diameter of the inner conduit can define a precise flow area for the air while maximizing the flow area for the ink within the inner conduit.

The example ink refill apparatus is 10, 110 may be used as a part of a method of refilling an ink cartridge as described with reference to the ink refill kit 101 shown in FIG. 7 and the steps of preparing an ink cartridge (FIGS. 8A-E) and filling the ink cartridge (FIGS. 9A-F). The example refill kit 101 (FIG. 7) includes an ink refill apparatus 10, a base member 66, a drill guide 64, and a drill 100.

A printer ink cartridge 90 having first and second ends 92, 94, a print head 96 at the first end 92, and a fill hole 98 at the second end 94 must first be prepared for refilling with ink. A first step in the preparation of the printer ink cartridge 90 is to remove a removable seal 99 from covering the fill hole 98 (see FIGS. 8A-B). Next, the drill guide 64 is secured to the second end 94 such that opening 65 of the drill guide is aligned with the fill hole 98 of the print cartridge (see FIGS. 8B-C). With the drill guide 64 in position, the drill 100 may be inserted through the opening 65 and the fill hole 98 and inserted into the ink chamber defined by the ink cartridge 90 (see FIG. 8C). Typically, the ink cartridge 90 includes foam or other absorbent material. Forcing the drill 100 into the foam material creates a fluid flow path down into the foam a desired distance. Such a flow path in the foam can improve ink flow into the cartridge 90 and improve absorption of the ink into the foam. The drill 100 may be rotated to facilitate creation of the ink flow path in the foam and improve the ease of inserting the drain and vent conduits into the cartridge. The issue of inserting the drain and vent conduits may be especially important in a refill kit that includes multiple sets of drain and vent conduits that are simultaneously inserted into the cartridge.

Figure 8B:
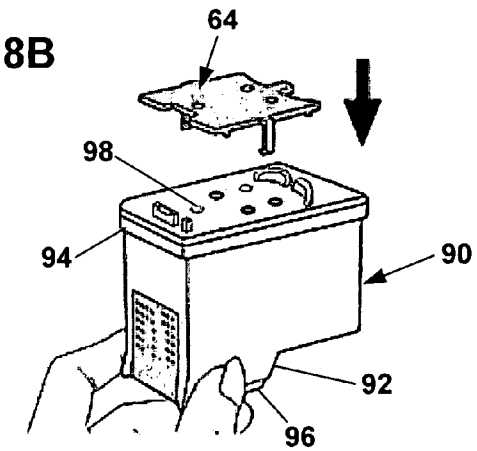
FIGS. 8A-E show example steps of preparing an ink cartridge for refilling using the ink refill kit shown in FIG. 7.
Figure 8A:
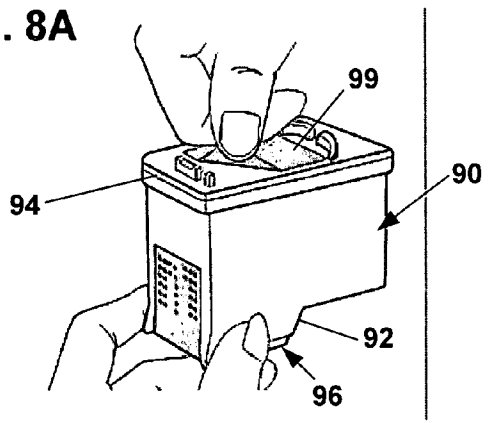
Figure 8E:
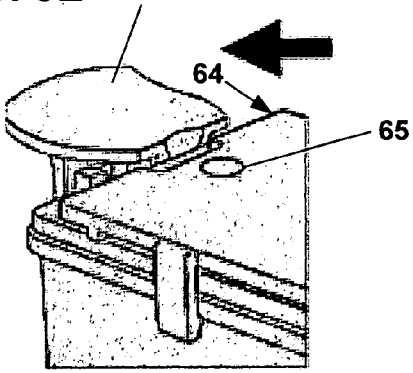
Figure 8D:
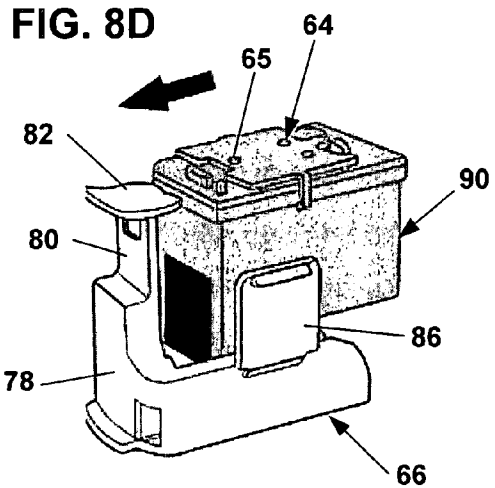
Figure 8C:
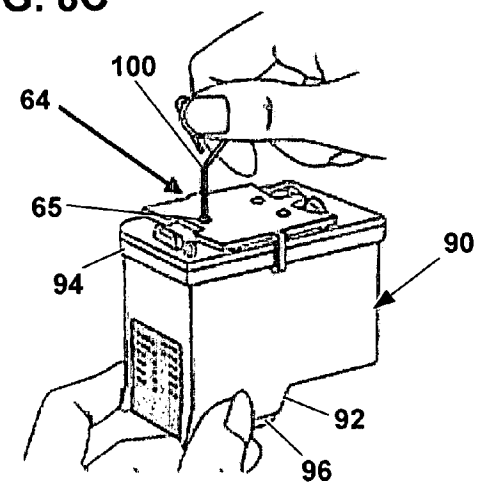

After drilling in the ink cartridge 90 with the drill 100, the drill is removed and the combination ink cartridge 90 with drill guide 64 is positioned within the base 66 (see FIG. 8D). The first end of 92 of the cartridge 90 is positioned in the cartridge seat 78 and the guide 82 is coupled to the second end 94 of the cartridge (see FIGS. 8D-E).

With the cartridge 90 mounted to the base member 66, the cartridge is now prepared for refilling with ink as shown in FIGS. 9A-F. First, the ink refill apparatus 10 is positioned with the lower housing member 60 facing upward so that there is no ink flow through the drain/vent assembly 15 when the cap 62 is removed (see FIG. 9A). Next, the prepare ink cartridge and base member 66 are turned upside down so that the second end 94 of the cartridge and the drill guide 64 are facing the drain/vent assembly 15 and at least the latch arm 86 aligns with the track portion 74 of the lower housing member 60 (see FIG. 9B). The drain/vent assembly 15 is then inserted through the opening 65 of the drill guide and the fill hole 98 of the print cartridge, and the base member 66 is inserted until it is enclosed within the lower housing member 60.

Figure 9C:
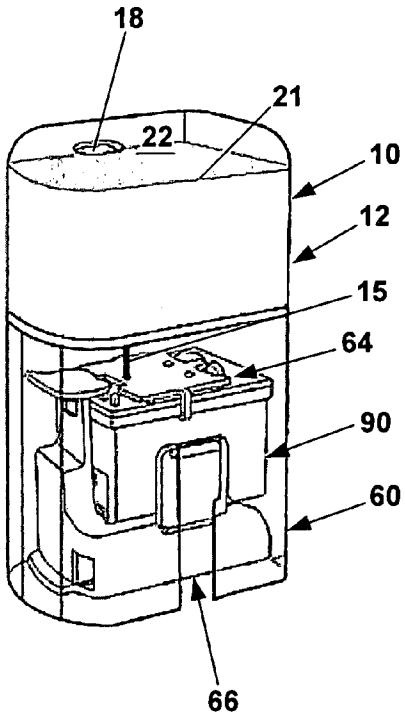
FIGS. 9A-F show example steps of filling an ink cartridge that has been prepared using the steps shown in FIGS. 8A-E.
Figure 9B:
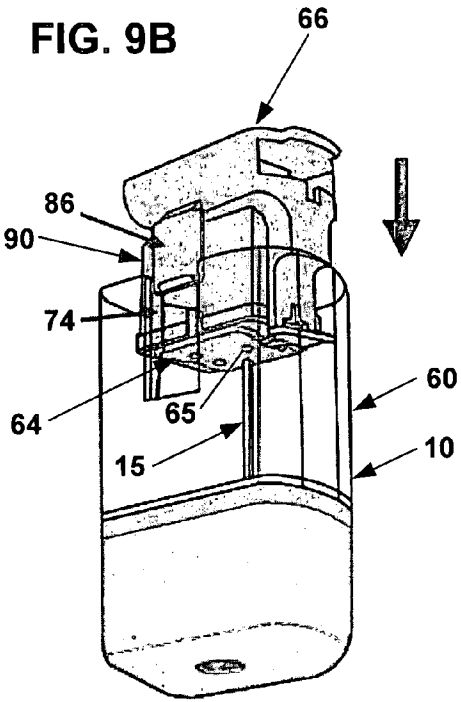
Figure 9A:
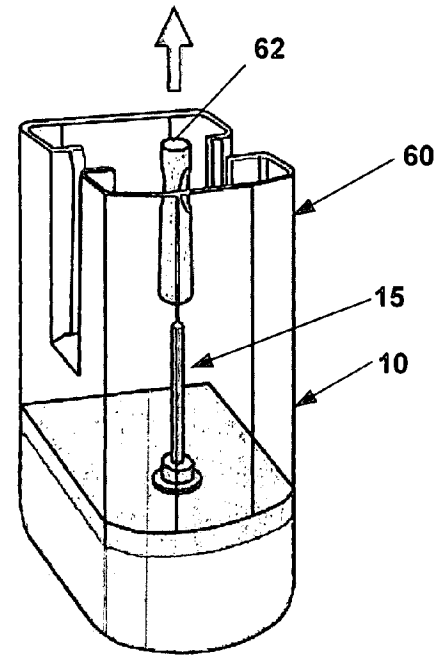
Figure 9D:
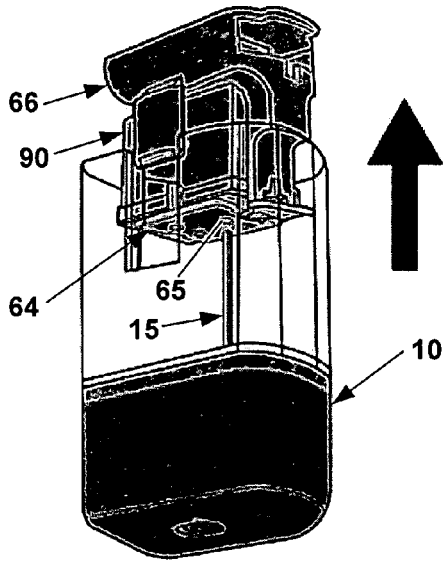
Figure 9E:
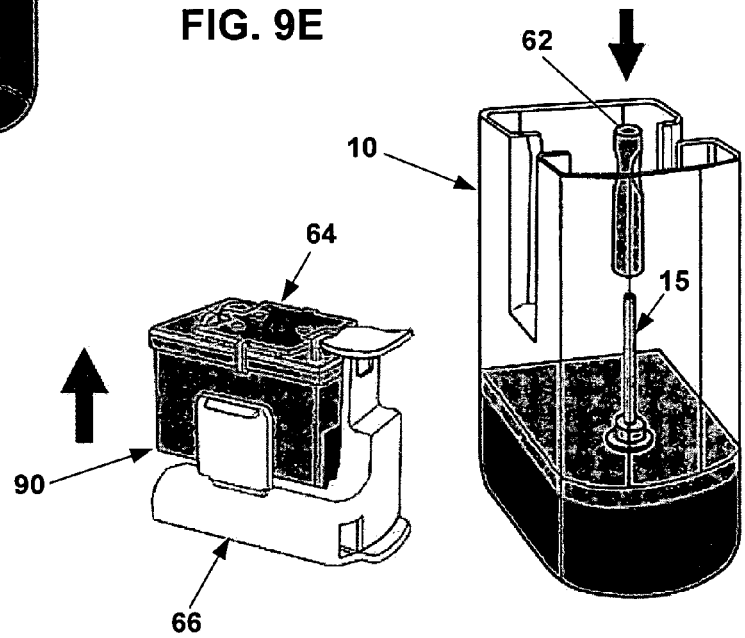
Figure 9F:
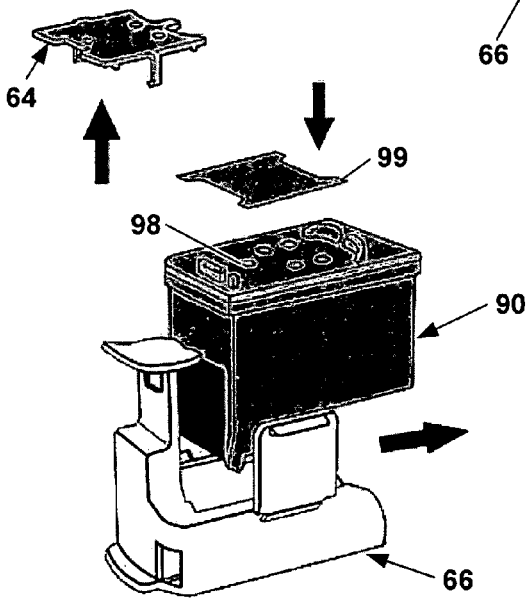

With the cartridge 90 and base member 66 coupled to the ink refill apparatus 10, the assembly of components is turned upright with the upper housing 12 vertically above the cartridge 90 (see FIG. 9C). Preferably, the outer walls of the upper housing 12 are transparent so that a user can watch for bubbles rising in the ink tank 22, which bubbles indicate ink flow through the drain/vent assembly 15 into the cartridge 90. If ink does not flow automatically, as indicated by the generation of bubbles in the ink tank or the lowering of the level of ink 21 in the ink tank, the pump member 18 can be depressed thereby changing the pressure condition in the ink tank (e.g., the pressure in the ink tank will increase when the pump member is depressed). Changing the pressure condition in the ink tank typically initiates ink flow in the drain/vent assembly 15. Once ink flow is initiated, the cartridge 90 will automatically fill with ink until filled to a predetermined level established by a position of the second opening into the vent conduit (e.g., that opening positioned within the ink cartridge during refilling).

A filled condition in the cartridge 90 is typically manifest when there are no bubbles being formed in the ink tank 22 and the ink level 21 is no longer changing. Once the cartridge 90 is filled to the desired level, the assembly is turned upside down again (see FIG. 9D), and the combined cartridge 90 and base 66 are removed from the ink refill apparatus 10. The combined cartridge 90 and base member 66 are then turned upright again (see FIG. 9E) and the cap 62 is replaced on the drain/vent assembly 15. In a final step, the cartridge 90 is removed from the base member 66, the drill guide 64 removed from the cartridge 90, and the removable seal 99 is replaced over the opening 98 in the cartridge 90 (see FIG. 9F).

After completing the process of filling the cartridge 90, a user may check for ink flow from the print head 96. If there is not ink already shown on print head 96 (which would indicate the cartridge 90 is ready for use), the user may imprint or press print head 96 on a tissue to see if there are any ink in the print head that will flow into the tissue (not shown). If there is no ink in the print head 96, the user may force ink into the print head 96 by inserting a blower (not shown) into the refill hole 98 or another "breather hole" or other venting in the opening in the cartridge 90 to force ink in the print head 96. When ink appears on print head 96 or if ink flows into a tissue against which print head 96 is imprinted, cartridge 90 is ready for use.

All the above method steps of preparing and refilling an ink cartridge are preferred, other method steps may be added or some of the above described steps may be removed when using different ink refill apparatuses or when refilling different ink cartridge configurations. For example, the base member 66 may be eliminated altogether and the ink cartridge and/or the ink refill apparatus may be configured for direct engagement or attachment of the ink cartridge to the ink refill apparatus during refilling of the ink cartridge. An example ink refill apparatuses that can be attached directly to an ink cartridge is shown and described with reference to U.S. Pat. No. 6,347,863.

Figure 10:
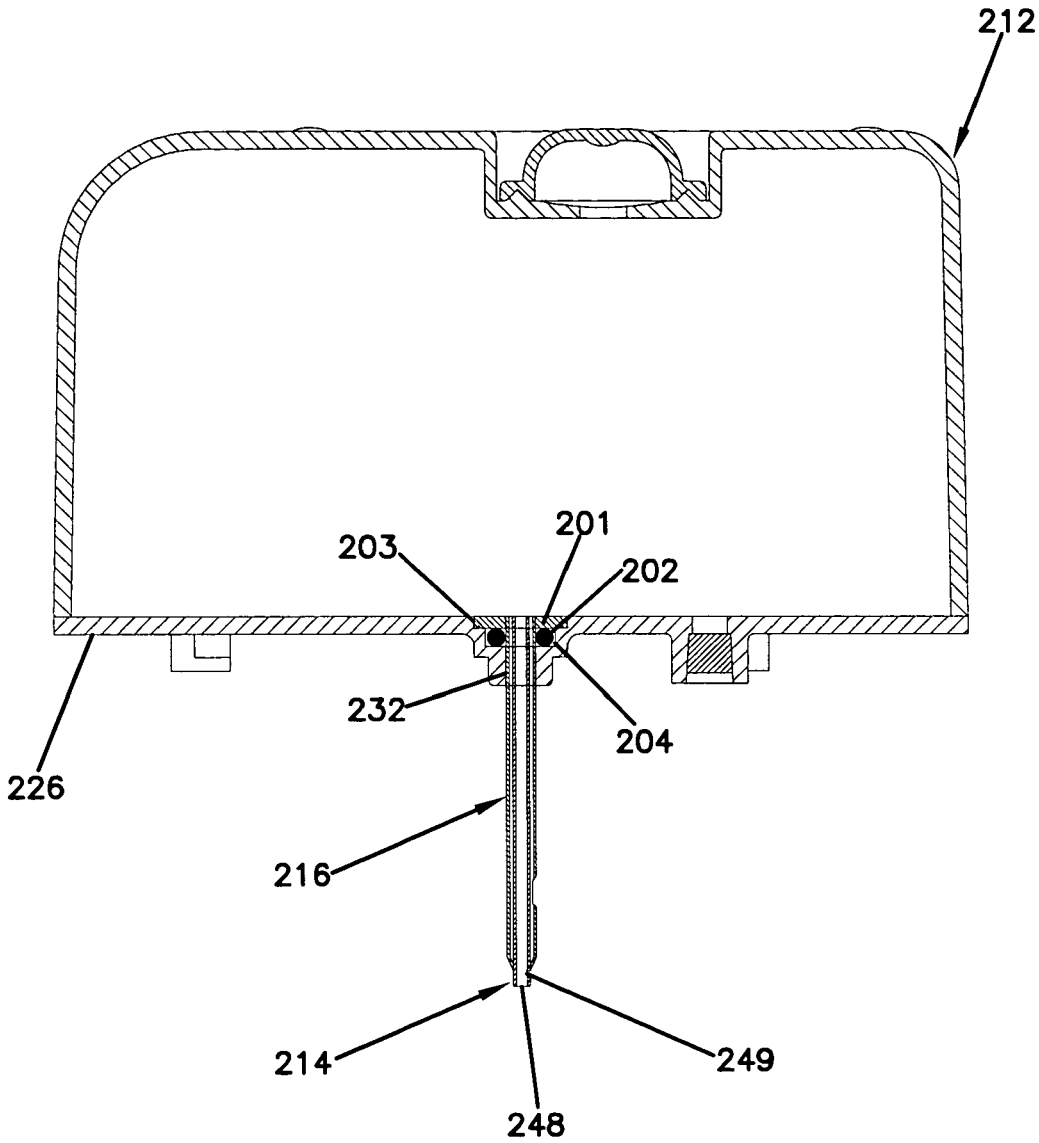
FIG. 10 is a cross-sectional view of the ink refill device shown in FIG. 1 including an alternative configuration for attaching the coaxially arranged drain and vent conduits to the ink tank.
Figure 11:
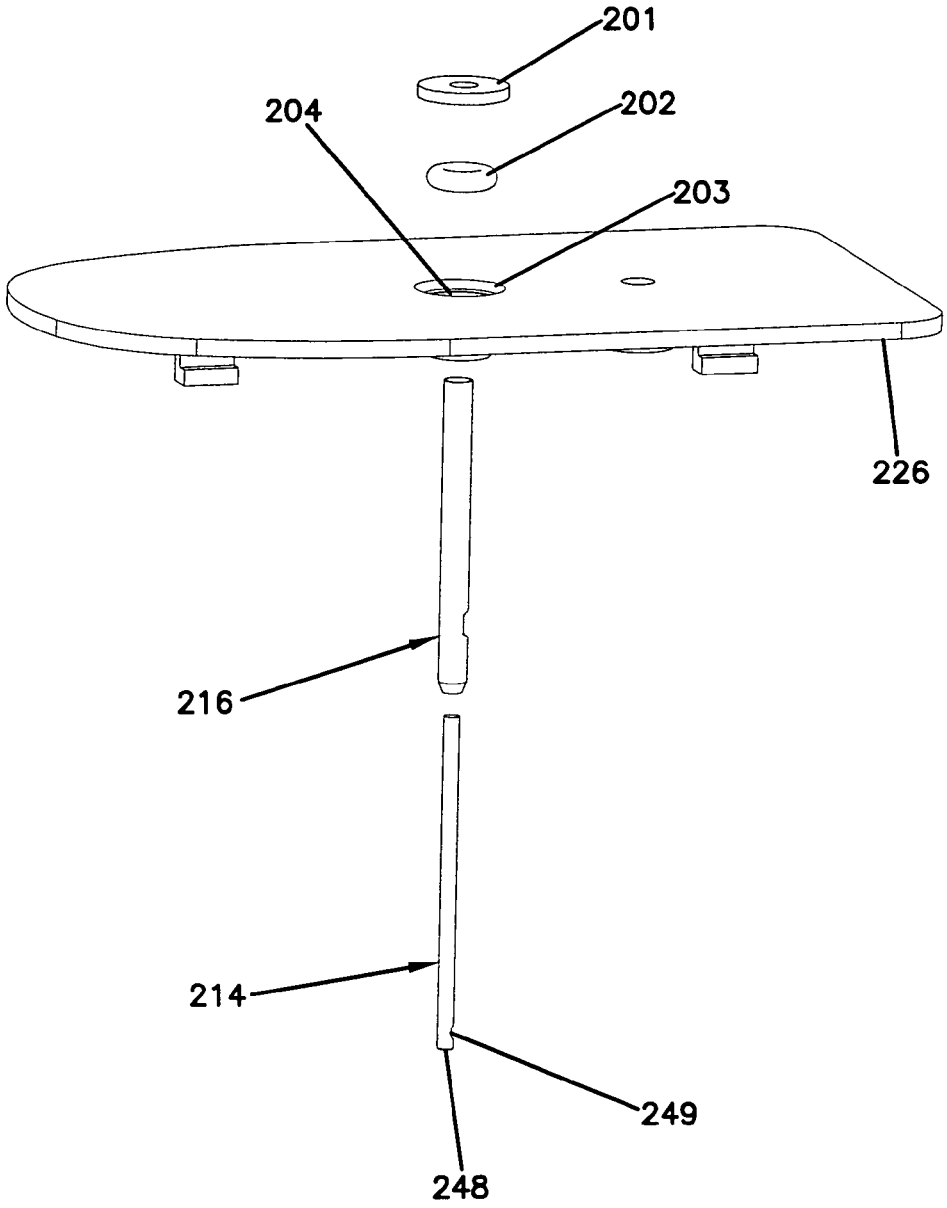
FIG. 11 is an exploded perspective view of a portion of the ink refill device shown in FIG. 10.

Referring now to FIGS. 10 and 11, an alternative configuration for attachment of a coaxial arrangement of the drain and vent conduits 214, 216 to an upper housing 212 is shown and described. The attachment arrangement includes an attachment member 201, an o-ring 202, and an attachment member recess 203 and an o-ring recess 204 formed in a bottom wall 224 of an upper housing member 212. The coaxially arranged drain and vent conduits 214, 216 extend through a vent and drain opening 236 formed in alignment with the recesses 203, 204 where the o-ring 202 and attachment member 201 are secured to an end of the vent conduit 216. The o-ring provide a fluid seal between an exterior of the vent conduit 216 and an internal ink tank 222 of the housing member 212.

The use of an o-ring or other such generally flexible sealing member at the connection point between the coaxially arranged drain and vent conduits 214, 216 and the housing member 212 may result in some advantages. Providing a reliable connection between of the conduits 214, 216 to the housing member 212 is important, but such a connection may not provide the desired sealing function in many embodiments. Depending on the materials and configuration of the bottom wall 226 and the tubes 214, 216, it may be difficult to provide a connection between those features that maintains a reliable seal (e.g., using adhesives, interference fits, welding, etc.) during multiple uses of the refill system. Using a sealing member (e.g., o-ring 202) to seal the conduits 214, 216 with the housing member 212 separate from the structure or other means used to secure the conduits 214, 216 to the housing member 212 permits optimizing of the sealing function. While FIGS. 10 and 11 illustrate an o-ring 202 as a sealing member, other sealing structures and materials may be used to provide a desired sealing function for any given ink refill system configuration.

The use of a sealing member such as o-ring 202 at the attachment point of the conduits 214, 216 to the housing member 212 is particularly effective for maintaining a fluid seal even when the conduits 214, 216 are moved in a lateral or axial direction relative to the axis of the conduits. Such lateral or axial movements in embodiments that do not include a sealing member (e.g., separate o-ring 202) may result in damage to the fluid seal the conduits 214, 216 to the housing member 212.

The attachment member 201 includes a cylindrical washer structure having an internal diameter substantially the same size as an outer diameter of the vent conduit 216. In other embodiments, the outer circumference may have alternative shapes and sizes and a thickness of the member 201 may vary as desired. The internal diameter may be modified to match the outer circumference structure of the conduit to which it is attached. Since the attachment structure 201 is not required to provide a sealing function when it is used with the sealing member 202, there is no requirement for the internal diameter to provide a sealing function.

In some embodiments, an attachment member such as member 201 may be used to both connect and seal the conduits 214, 216 to the housing member 212. In other embodiments, a sealing member may be positioned on an opposing side of the attachment member than the orientation shown in FIGS. 10 and 11. In still further embodiments, a sealing member may be integrated into the attachment member, such as defining an inner diameter surface of the attachment member.

In some embodiments the attachment member 201 and o-ring 202 may be secured within respective recesses 203, 204 or to each other using, for example, adhesives, interference fits, co-molding, etc. Similar attachment means may be used to secure the attachment member 201 and o-ring 202 to the conduits 214, 216. In other embodiments, the recesses 203, 204 may be formed as a single recess rather than as two recesses having different dimensions as shown in FIGS. 10 and 11. In still further embodiments, one or both of the attachment member 201 and o-ring 202 may be positioned within the internal ink tank 222 rather than positioned in whole or in part within a recess formed in a wall of the housing 212.

Other configurations for securing and sealing the drain and vent conduits of the ink refill device to the housing may be used within the spirit and scope of the present disclosure. For example, a similar o-ring shaped sealing member and washer shaped attachment member may be used to attach different single conduit profile drain and vent member such as, for example, the bi-sectional vent and drain conduits 114, 116 shown in FIGS. 4-6.

The drain conduits 14, 114, 214 shown and described herein including a primary opening (e.g., 48, 148, 248) at the bottom end of the respective conduits. This opening faces downwards toward the foam of a cartridge when the conduit 14, 114, 214 is inserted into an opening formed in the foam as a result of pre-drilling of the foam with a foam drill. In some instances, the opening in the foam is not drilled to a depth greater than a length of the drain tube that is inserted into the cartridge. As a result, the opening 48, 148, 248 may be blocked by the foam and the flow of ink through the drain conduit is restricted. To address this potential drain problem, another opening 249 (see FIGS. 10 and 11) may be formed in a side of the drain conduit near the bottom end of the drain conduit. The opening 249 can provide an alternate ink flow path out of the drain conduit to ensure proper ink flow into the cartridge.

The principles of the present disclosure related to a single elongate conduit profile for the drain/vent assembly can be applied to many other refill ink apparatuses than those shown and described with reference to FIGS. 1-11. A single profile configuration provides several advantages over a configuration that includes two separately mounted, side-by-side conduits for use as the drain and vent conduits, as described above.

The above specification provides examples of how certain inventive aspects may be put into practice. It will be appreciated that the inventive aspects can be practiced in other ways than those specifically shown without departing from the spirit and scope of the inventive aspects.

I claimed:

1. An ink cartridge refill system configured to refill an ink chamber of an printer ink cartridge with ink, the system comprising:

an ink container configured to be coupled to the ink cartridge, the ink container defining at least one internal ink tank;

a drain conduit in fluid communication with the at least one internal ink tank and projecting outwardly from the ink container; and a vent member extending coaxially with the drain conduit.

2. The system of claim 1, wherein the vent member has a length and the drain conduit has a length greater than the length of the vent member.

3. The system of claim 1, wherein the vent member has a cross-sectional flow area less than a cross-sectional flow area of the drain conduit.

4. The system of claim 1, wherein the drain conduit and vent member each including opposing ends that are open.

5. The system of claim 1, wherein the vent member defines an aperture in a side wall thereof, the aperture positioned at a location between opposing ends of the vent member.

6. The system of claim 1, wherein the ink container includes a bottom interior wall, a top interior wall, and at least one side interior wall, and the drain conduit includes a first opening positioned near the bottom interior wall and a second opening located externally of the ink container.

7. The system of claim 1, wherein the drain conduit and vent member each include a first opening in fluid communication with the internal ink tank and a second opening located externally of the ink container, the second opening of the vent member being positioned closer to the internal ink tank than a position of the second end of the drain conduit.

8. The system of claim 1, further comprising a sealing member coupled between the vent and drain conduits and the ink container to provide a fluid seal there between.

9. The system of claim 8, further comprising an attachment member configured for attachment of the drain and vent conduits to the ink container.

10. An ink cartridge refilling system configured to refill a housing interior of a printer ink cartridge, the system comprising:

an ink container having at least one ink reservoir and configured to be connected to the printer ink cartridge housing;

at least one ink communication path in fluid communication with the at least one ink reservoir;

at least one vent communication path in fluid communication with the at least one ink reservoir;

wherein a combination of the at least one ink communication path and the at least one vent communication path is defined within a single elongate conduit profile by a coaxial arrangement of the at least one ink communication path and the at least one vent communication path.

11. The system of claim 10, wherein the at least one ink communication path is oriented at least partially within an interior space defined by the at least one vent communication path.

12. The system of claim 10, wherein the at least one vent communication path includes an opening defined therein between first and second ends of the at least one vent communication path.

13. The system of claim 10, wherein the ink container includes a bottom internal wall, a top internal wall, and at least one side internal wall that define the at least one ink reservoir, and one end of the at least one ink communication path terminates near the bottom internal wall and another end of the at least one ink communication path is positioned outside of the ink container.

14. A method of assembling an ink refill system, the method comprising steps of:

providing an ink container, a drain conduit, and a vent member, the drain conduit and vent member together defining an elongate member having a generally cylindrical circumferential cross-section;

coupling the elongate member to the ink container, wherein a first end of each of the drain conduit and the vent member is exposed within the ink container and a second end of each of the drain conduit and vent member is exposed outside of the ink container; and arranging the drain conduit and vent member in a coaxial arrangement.

15. The method of claim 14, wherein the drain conduit is positioned at least partially within the vent member.

16. An ink cartridge refill kit, comprising:

a package; and an ink refill system positioned in the package, the ink refill system including an ink tank, a drain conduit, and a vent conduit, the drain conduit being in ink flow communication with the internal ink tank, the vent conduit being in air flow communication with the internal ink tank, and the drain conduit and air conduit extending coaxially from a position exposed to the ink tank to a position exterior of the ink tank.

17. The refill kit of claim 16, wherein the ink refill system further comprises a cap configured to cover ends of the drain and air conduits positioned outside of the ink tank.

18. A method of refilling an ink cartridge with an ink refill system, the ink refill system including a drain conduit, a vent member, and an ink container filled with ink, the method comprising the steps of:

forming an aperture in a wall of the ink container;

defining the drain conduit and vent member within a single elongate conduit profile, wherein the drain conduit and vent member extend coaxially;

inserting the drain conduit and vent member into the aperture; and draining ink out of the ink container through the drain conduit and filling the ink container with air through the vent member to fill the ink cartridge.

19. The method of claim 18, further comprising automatically stopping the draining of ink out of the ink container when an ink level in the ink cartridge covers an exposed opening into the vent member.

20. An ink cartridge refill system configured to refill an ink chamber of an printer ink cartridge with ink, the system comprising:

an ink container configured for coupling in ink flow communication with the ink cartridge, the ink container defining at least one internal ink tank, the ink tank including a bottom wall having a conduit aperture form therein;

a drain conduit in fluid communication with the at least one internal ink tank through the conduit aperture and projecting outwardly from the ink container;

a vent member extending coaxially with the drain conduit and in fluid communication with the at least one internal ink tank; and a sealing member positioned between the ink container and at least one of the drain and vent conduits to provide a fluid seal there between.

21. The system of claim 20, further comprising an attachment member configured to secure the at least one of the drain and vent conduits to the ink container.

22. The system of claim 21, further comprising a recess formed in the bottom wall, wherein the sealing member and the attachment member are positioned in the recess.

* * * * *